United States Patent [19]

Childs et al.

[11] 4,193,853

[45] Mar. 18, 1980

[54] DECONTAMINATING METAL SURFACES

[75] Inventors: Everett L. Childs, Boulder; Jack L. Long, Arvada, both of Colo.

[73] Assignee: The United States of America as represented by the United States Department of Energy, Washington, D.C.

[21] Appl. No.: 39,428

[22] Filed: May 15, 1979

[51] Int. Cl.[2] ..... C25F 3/02

[52] U.S. Cl. ..... 204/129.95; 204/129.75

[58] Field of Search ..... 204/129.75, 129.8, 129.95

[56] References Cited

U.S. PATENT DOCUMENTS

| | | | |
|---|---|---|---|
| 1,863,868 | 6/1932 | McCullough | 204/129.95 |
| 3,355,369 | 11/1967 | Chaperon | 204/129.65 |
| 3,446,713 | 5/1969 | Raviv | 204/129.8 |

*Primary Examiner*—T. M. Tufariello

*Attorney, Agent, or Firm*—R. V. Lupo; Dudley W. King; Robert Southworth, III

[57] ABSTRACT

This invention relates to an electrolyte and an electrolytic method for removing radioactive contaminants from the surface of a metallic substrate.

8 Claims, 3 Drawing Figures

DECONTAMINATING METAL SURFACES

FIELD OF THE INVENTION

The invention relates to electrolytically decontaminating metal surfaces.

BACKGROUND OF THE INVENTION

In the nuclear industry, metal equipment such as pumps, valves, piping, ventilation ductwork, gloveboxes, machinery, tooling, and structural members may become surface-contaminated with radioactive substances. This surface contamination may be from actinides such as plutonium or americium, fission products as encountered in nuclear fuel reprocessing, or radioactive deposits in nuclear reactor piping.

When such contaminated equipment is taken out of service, it must be decontaminated before being either returned to service or otherwise disposed of. As radioactively-contaminated waste may require expensive continuing care, it is desirable to minimize the volume of material requiring such care. Furthermore, as the contaminated metal or the contaminant may be valuable, it could be desirable to recover as much as possible.

In the disposal of metal articles surface-contaminated with plutonium, those items showing a radioactivity of greater than 23,454 alpha disintegrations per minute per square inch (d/m/in$^2$) are placed in "retrievable" storage. This is expensive storage with the article being hermetically contained and available for further processing at a future date. Articles having radioactivity less than 23,454 alpha d/m/in$^2$ are classified as "non-retrievable" waste and are eligible for permanent burial in geological strata. This disposal option is relatively expensive. Articles having radioactivity of less than 32 alpha d/m/in$^2$ may be disposed of in relatively cheap "landfill" disposal. Articles having a surface radioactivity of less than 1 alpha d/m/in$^2$ are essentially "background" and require no special treatment or disposal.

Prior art techniques for removing surface contamination from metal articles include such manual techniques as washing, scrubbing, and mechanically abrading the surface of the metal article. These techniques are generally successful in removing gross deposits of contamination from exterior surfaces but are unsuccessful in removing contamination from interior surfaces, cracks, crevices, or pores in the surface of metal articles. The metal waste would then be stored in one of the expensive permanent care facilities.

A recent development in the decontamination of metal is electropolishing which comprises electrolytically dissolving a surface layer of the metal article in a bath of phosphoric acid. The plutonium which is thereby removed from the surface of the metal is then recovered from the phosphoric acid solution by sophisticated chemical techniques such as ion exchange, solvent extraction, chemical precipitation, distillation, electrolysis, or membrane separation. The spent phosphoric acid solution is then neutralized and itself be disposed of as radioactive waste. When handling fissile material, criticality safety requires a nuclear poison. This can be achieved by the addition of cadmium to the phosphoric acid electrolyte but the cadmium would then be an additional disposal problem because of its health hazard.

SUMMARY OF THE INVENTION

In view of the above-noted difficulties and disadvantages, it is an object of this invention to provide a novel method and electrolyte for electrolytically decontaminating metal objects which are surface-contaminated by radioactive substances.

It is a further object of this invention to provide a method for decontaminating metal which requires a minimum amount of manual labor and a minimum exposure of personnel to radiation.

It is a still further object of this invention to provide a method for decontaminating metal which results in a minimum amount of residual material which is radioactively contaminated.

The invention comprises an improved method and electrolyte for decontaminating a metal object which is surface-contaminated with a radioactive substance. The electrolyte comprises a basic aqueous solution containing nitrate, borate, fluoride, and oxalate anions. The method comprises electrolytically removing a surface layer of the metal in a bath of the electrolyte and separating precipitate which is thereby formed so that the electrolyte may be reused.

BRIEF DESCRIPTION OF THE DRAWINGS

Other objects and advantages of the present invention will be apparent to those skilled in the art from the following description with reference to the appended claims wherein like numbers denote like parts and wherein:

DESCRIPTION OF A PREFERRED EMBODIMENT

Figure 1:
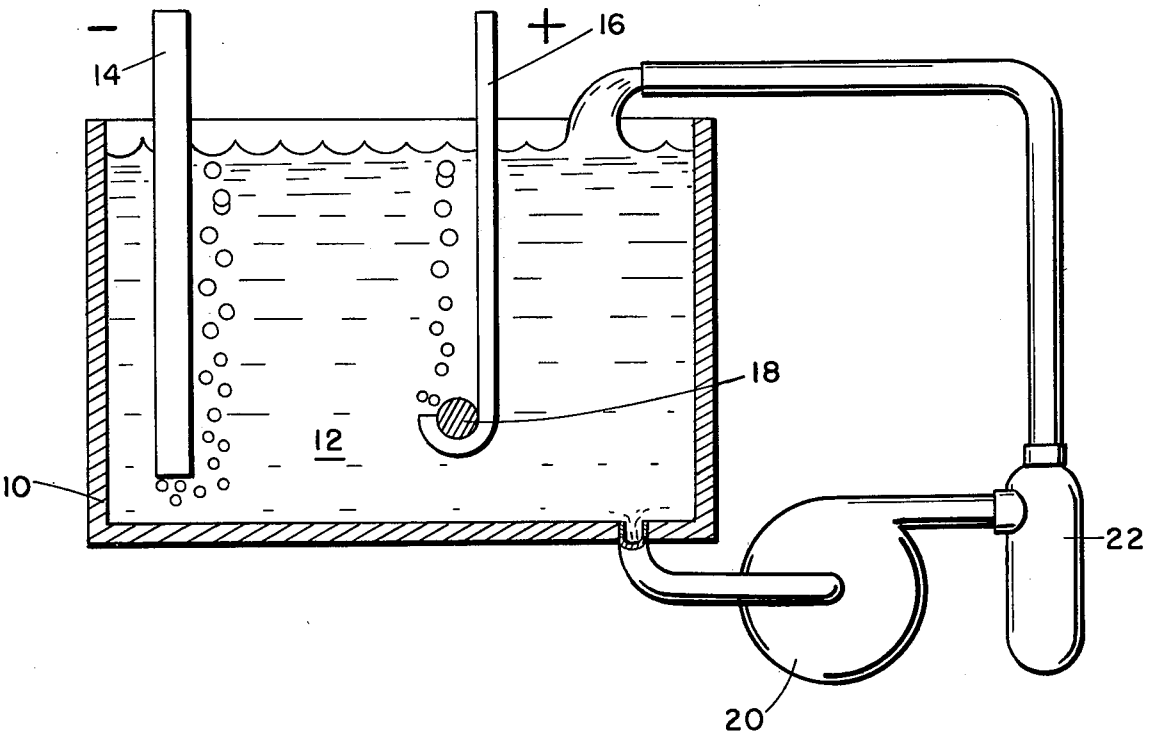
FIG. 1 illustrates apparatus useful in practicing the invention.

An electrolyte which has been found to be superior for use with the method of this invention is a basic aqueous solution containing nitrate, borate, fluoride and oxalate anions. Such a solution may be made by dissolving from 50 to 500 and preferably about 200 g $NaNO_3$, from 1 to 20 and preferably 20 g $Na_2B_4O_7 \cdot 10H_2O$, from 0.1 to 2.5 and preferably 2 g NaF, and from 0.1 to 4 and preferably 2 g $Na_2C_2O_4$ in one liter of water.

In the prior art of electrolytic etching, machining, or polishing various electrolytes are described which contain nitrate salts. See, for example U.S. Pat. Nos. 1,314,839; 2,561,222; 2,872,387; 3,239,441; 3,420,759; 3,779,877; 3,964,914 and 4,026,779. Other U.S. Patents describe nitrate-free solutions containing oxalate (U.S. Pat. No. 1,863,868), fluoride (U.S. Pat. No. 3,355,369), or borate (U.S. Pat. No. 2,506,582) anions. None of these utilizes the particularly satisfactory combination taught by the present invention. In addition, these prior electrolytes are generally acidic as opposed to the basic pH of the present invention.

The use of the nitrate anion in the present invention is desirable since this process then becomes compatible with other nitrate-based chemical processes used in the nuclear industry without the need for costly and inefficient intermediate steps. For example, plutonium is routinely handled in nitrate solutions since it forms a $Pu(NO_3)_6^{-2}$ complex which then can be purified using anion exchange techniques. It has been found that solutions containing from 50 to 500 and preferably 200 g/1 $NaNO_3$ gives satisfactory results.

The use of the fluoride ion has been found, especially in decontaminating low levels of plutonium on stainless steel, to improve the efficiency of decontamination. Less time and less etching of the substrate metal is required to produce a given level of decontamination. It has been found that from 0.1 to 2.5 and preferably 2.0 g/1 NaF gives satisfactory results.

The use of the borate ion, and more particularly the tetraborate or pyroborate ion, provides a two-fold benefit. Firstly, $Na_2B_4O_7 \cdot 1OH_2O$ or borax hydrolyses in water to yield a basic solution. The solutions employed in the method of this invention generally have a pH from 7 to 11 and usually about 9. Many elements including plutonium and americium form insoluble precipitates in basic solutions which may be expediently removed by filtrations. Secondly, aqueous solutions or suspensions of fissible materials such as thorium, uranium or plutonium must be "poisioned" or otherwise controlled against unwanted neutron chain reactions or criticality excursions. Isotopes such as boron-10 have an unusually high cross-section for the absorption of thermal neutrons and this may be used to "poison" such neutron reactions. It has been found that from 1 to 20 and preferably 20 g/1 $Na_2B_4O_7 \cdot 1OH_2O$ gives satisfactory results.

The use of the oxalate ion with the present invention is desirable since it has been found to promote the formation of more filterable precipitates. Without its use, the hydroxide precipitates formed are slow to settle and difficult to filter. It has been found that from 0.1 to 4 and preferably 2 g/1 $Na_2C_2O_4$ gives satisfactory results.

Reference is now made to FIG. 1 which illustrates apparatus useful in practicing the present invention. A tank 10 is employed to contain electrolyte 12 the composition of which is described hereinabove. Immersed in the electrolyte is a negative electrode or cathode 14 and a positive electrode or anode 16. Suspended from or otherwise in good electrical contact with the anode is the object to be cleaned 18. The object to be cleaned may be of a metal such as but not limited to copper, lead, aluminum, or any of the iron-chrome-nickel alloys such as stainless steel. A DC current imposed between the anode and cathode causes the dissolution or etching of the surface of the metal object 18 and removal of radioactive contaminants present. Because the electrolyte is basic, many elements will be precipitated as hydroxides and may be conveniently removed by such as a recirculating pump 20 and filter 22. It will be appreciated if tank 10 is employed as an electrode, reversing the direction of current will facilitate decontamination of the tank surface.

It has been found that a voltage in the range of 4 to 24 volts with a current density of 1 to 8 and preferably 4 amperes per square inch gives satisfactory results. Surprisingly, higher current density levels have exhibited greater efficiency at removing contamination than have lower current density levels.

Figure 2:
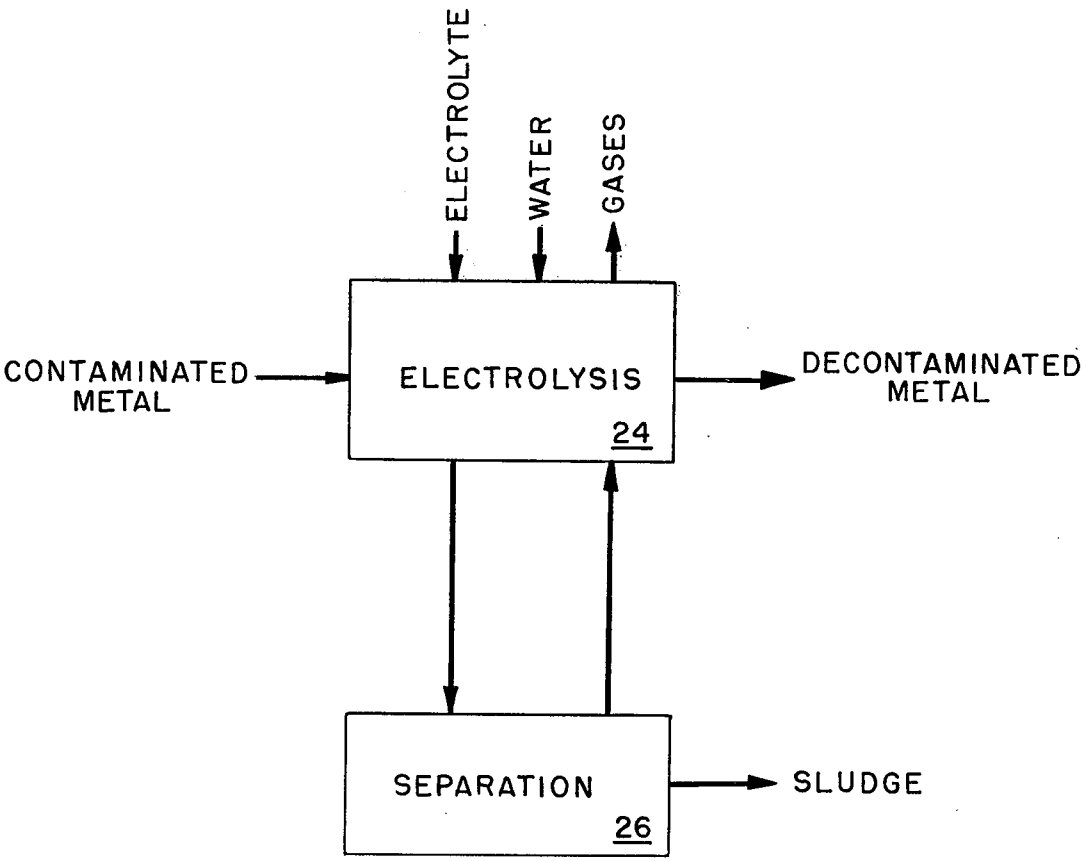
FIG. 2 illustrates a flow diagram of the method of the invention.

Reference is now made of FIG. 2 which illustrates a flow diagram of the method of the invention. As can be seen, contaminated metal is decontaminated by electrolysis step 24 to produce decontaminated metal. Contaminated sludge is removed via an appropriate solid/liquid separation step 26 such as filtration. The recycled electrolyte may be used indefinitely. As required, additional electrolyte and water may be added to replace losses with the sludge, evaporation or decomposition to hydrogen and oxygen.

Material balance estimates have shown that electrolytic cleaning of 520 square feet of stainless steel to the non-retrievable level will consume 4 liters of fresh electrolyte and 100 liters of water while producing 450 liters of hydrogen and oxygen gases. If the stainless steel is to be decontaminated to non-retrievable storage level (23,454 d/m/in$^2$), it is estimated to require a 1-minute electrolysis time removing 0.1 mill of surface and producing 10 pounds of sludge for storage. In order to decontaminate to landfill standards (32 d/m/in$^2$), it would require 6 minutes to remove 0.7 mils of surface and would produce 70 pounds of sludge. In order to reduce the contamination level to background (1 d/m/in$^2$), it would require 12 minutes to remove 1.4 mils and would produce 140 pounds of sludge.

Figure 3:
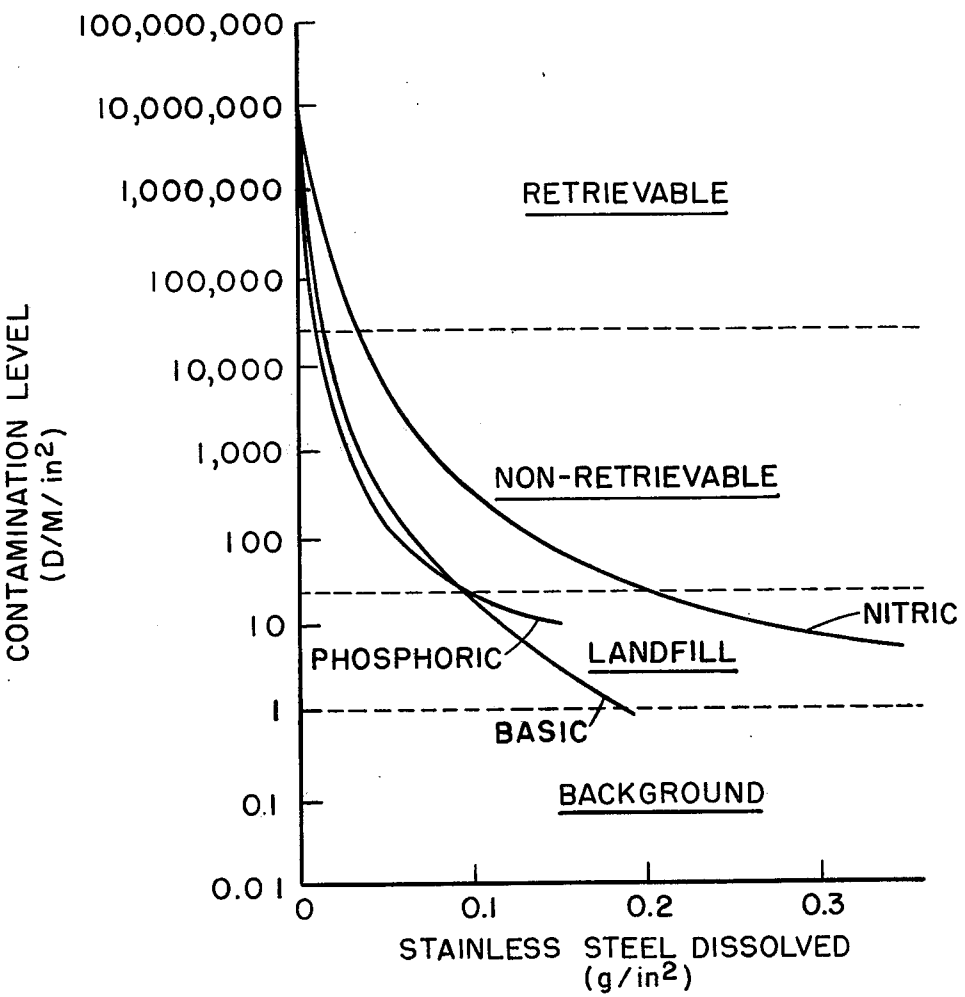
FIG. 3 illustrates comparative cleaning efficiencies of the electrolyte of the present invention.

A comparison between decontamination with basic electrolyte and phosphoric acid electrolyte and nitric acid electrolyte is shown in FIG. 3. It is seen that a given amount of contamination is removed using the present invention with much less removal of the substrate metal than is removed by the nitric acid electrolyte. Comparison with the phosphoric acid electrolyte shows that the present invention removes a given amount of contamination with equal or less than the amount of substrate metal removed.

The various features and advantages of the invention are thought to be clear from the foregoing description. However, various other features and advantages not specifically enumerated will undoubtedly occur to those versed in the art, as likewise will many variations and modifications of the preferred embodiment illustration, all of which may be achieved without departing from the spirit and scope of the invention as defined by the following claims.

We claim:

1. A process for decontaminating an object having a surface contaminated with a radioactive substance comprising: contacting said object with a basic aqueous solution containing nitrate, fluoride, borate, and oxalate anions; thereafter electrolytically removing a surface layer of said object; and subsequently separating resulting precipitate from said solution.

2. The process of claim 1 further comprising reusing said solution after said separating said precipitate.

3. The process of claim 1 wherein the basic aqueous solution comprises from 50 to 500 g/1 $NaNO_3$, from 0.1 to 2.5 g/1 NaF, from 1 to 20 g/1 $Na_2B_4O_7 \cdot 1OH_2O$, and from 0.1 to 4 g/1 $Na_2C_2O_4$; said solution having a pH from 7 to 11.

4. The process of claim 2 wherein the basic aqueous solution comprises about 200 g/1 $NaNO_3$ about 2 g/1 NaF, about 20 g/1 $Na_2B_4O_7 \cdot 1OH_2$, and about 2 g/1 $Na_2C_2O_4$; said solution having a pH about 9.

5. The process of claim 1 wherein said electrolysis is conducted with a potential of from 4 to 24 volts, a current density of from 1 to 8 amps/in$^2$, and at a temperature of from 25° to 90° C.

6. The process of claim 1 wherein the object is of an alloy including at least one of the metals iron, chromium, nickel, aluminum, copper, or lead and the radioactive substance is an actinide.

7. The process of claim 1 wherein the metal object is stainless steel and the radioactive substances is plutonium or americium.

8. A basic aqueous solution for electrochemical machining comprising from 50 to 500 g/1 $NaNO_3$, from 0.1 to 2.5 g/1 NaF, from 1 to 20 g/l $Na_2B_4O_7 \cdot 1OH_2O$, and from 0.1 to 4 g/1 $Na_2C_2O_4$.

* * * * *